US005212899A

United States Patent [19]

Fandreyer

[11] Patent Number: 5,212,899

[45] Date of Patent: May 25, 1993

[54] SWITCH PLATE LABELLING ASSEMBLY

[76] Inventor: Gerhard Fandreyer, 509 Clark St., Gardner, Mass. 01440-1205

[21] Appl. No.: 722,113

[22] Filed: Jun. 27, 1991

[51] Int. Cl.[5] ..... G09F 3/18

[52] U.S. Cl. ..... 40/642; 174/66

[58] Field of Search ..... 40/5, 152, 152.1, 594, 40/611, 642, 649, 653; 174/66, 67; 220/241

[56] References Cited

U.S. PATENT DOCUMENTS

| | | | |
|---|---|---|---|
| 1,930,610 | 10/1933 | Despard | 174/66 X |
| 3,953,933 | 5/1976 | Goldstein | 40/152 |
| 4,349,975 | 9/1982 | Chubb | 40/634 X |
| 4,425,725 | 1/1984 | Moustakas et al. | 174/66 X |
| 4,756,106 | 7/1988 | Foster | 40/594 X |
| 4,780,573 | 10/1988 | Own | 174/66 |
| 5,018,291 | 5/1991 | Pasquale et al. | 40/642 |

*Primary Examiner*—Kenneth J. Dorner
*Assistant Examiner*—Brian K. Green
*Attorney, Agent, or Firm*—Robert K. Tendler

[57] ABSTRACT

A switch plate labelling assembly is provided by a label holder which includes a unitary frame having an apertured base plate in which the frame, in one embodiment, is attached over a standard switch plate utilizing a screw normally used to anchor the switch plate to the switch. In one embodiment, the aperture is provided with a frustoconical portion projecting rearwardly from the back surface of the base, with the aperture being offset downwardly from the center of the base to permit the frame and the label it carries to provide a maximum amount of labelling area and still remain within the confines of the switch plate. The label holder may be used for switches, plugs, or other electrical apparatus which are fastened to outlet boxes in which a covering device is employed and secured in place with screws. A removable label is contained under a flexible transparent sheet having opposed tabs which are insertable into mating slots or notches in the frame, with the slots having been made in the frame by either drilling from the back of the base or through the utilization of a molding insert or projection during the molding of the unitary frame/base structure. In an alternative embodiment the label holder can be provided with an adhesive backing material for general use. The removal of the flexible transparent sheet and label can be easily accomplished by inserting a small pointed object along the sides of the transparent sheet at which the slots are located followed by a prying up step.

2 Claims, 4 Drawing Sheets

SWITCH PLATE LABELLING ASSEMBLY

FIELD OF THE INVENTION

This invention relates to labelling devices and more particularly to the labelling of conventional switch plates through the utilization of a label holder especially adapted for switch plate mounting and manufactured at minimal cost while at the same time providing for easy label changing to suit an individual's needs.

BACKGROUND OF THE INVENTION

As illustrated in U.S. Pat. No. 1,930,610, it is highly desirable to be able to provide a label for switch plates, sockets, and alike, and to this end the above-mentioned patent describes the insertion of a labelling device through an aperture in the switch plate, with the aperture being large enough to accommodate the switch or socket therethrough.

As discussed in this patent, the name plate or cardholder is held in place by virtue of a tab from the name plate which is inserted into this aperture. However, switch plates are no longer made in the fashion described in this patent. Present switch plates now have standardized apertures above and below the switch to accommodate mounting screws and do not have an aperture around the switch itself through which a tab-like structure could be pushed.

Moreover, the card labelling device shown in the above-identified patent is not easily removable. Removable labels for other types of devices are shown in U.S. Pat. Nos. 2,934,844; 3,918,187; 3,838,529; 2,570,678; and 2,176,253. However, in all of these patents, the labelling device is not utilized with a switch plate and is not mounted in any way utilizing screws which normally hold a switch plate in place.

By way of further background, U.S. Pat. No. 3,183,613 illustrates the labelling of an electrical appliance through the utilization of a flexible transparent member which is flexed to permit removal of the underlying label. The insertion of the label is followed by the insertion of a transparent cover plate which when is in its rest position relaxes with the edges thereof in an integral groove to either side of the viewing aperture. Thus, the overlying transparent resilient piece snaps into place into guides or slots provided for that purpose. However, such a labelling device requires that the slots be integrally formed in the body of the appliance.

Other label holding devices include U.S. Pat. Nos. 1,119,303; 1,581,981; 1,401,280; 4,026,033; 2,624,965; 4,035,940; 4,875,234; 4,729,183; 3,698,111; 3,921,798; 4,617,748; and 4,694,596. While various of the above-mentioned patents have labels secured in a frame-like structure having lips which prevent the cover for the label and the label itself from coming out of the frame, none of the above-mentioned patents show a label holder which is easily formed in a one-step molding process in which label retaining slots or grooves are formed quickly, easily, and inexpensively. A large number of the label holders in the Patents listed above are made of metal frames which are bent or otherwise formed in costly operations. Moreover, with the exception of the first-mentioned patent, none of the above patents relate to labelling of switch plates per se. Additionally, while some of the patents illustrate methods of affixing the label holder to a substrate involving a nail or screw, none of the above-mentioned patents secure the label holder to an underlying substrate utilizing the self-same screws or bolts that are utilized to attach the substrate to some further structure.

Further, U.S. Pat. No. 3,009,381 shows the fastening of a name plate through the utilization of plastic fastening elements similar to studs and, in any event, is not utilized for switch plate labelling.

Finally, while U.S. Pat. No. 2,093,598 relates to a glass supported dual card holder, it will be appreciated that while this is an adhesively mounted card holder, the adhesive is on the same side of the holder as the aperture through which the label is to be seen or viewed. This last-mentioned patent is directed solely to affixing labels to glass through which the indicia on the label is to be viewed, and, in any event, is not for use in labelling of switch plates.

SUMMARY OF THE INVENTION

In order to easily label existing switch plates or the plates normally utilized for electrical sockets, junction boxes, and the like, and noting that these cover plates have provisions for receiving mounting screws at standard locations above and below either a switch or a socket, it is the purpose of this invention to provide a label holder which is secured to the cover plate utilizing the self-same screws that are utilized to anchor the cover plate to the switch. Moreover, the labelling device provides labelling indicia immediately adjacent the switch at a convenient location, with location specified by virtue of the mounting system for the label holder. In one embodiment, the label holder is positioned immediately above the switch on the surface of the switch plate, either through the utilization of the screw which is normally located immediately above the switch, or through the utilization of double sticky back tape or an adhesive fastening system which properly locates the label holder. In any event the label is positioned over a cover plate mounting screw.

With respect to the utilization of the cover plate screw, the label holder generally includes a unitary frame having a backing or base plate through which there is an offset aperture positioned such that the majority of the label carrying area extends above the aperture. This permits large letter labelling of the cover plate because increased label area can be provided over that which could be available with a centered hole. The aperture in one embodiment has a frustoconical portion which extends rearwardly of the base so as to mate with the generally tapered aperture in the cover plate. In general, cover plates carry countersunk apertures. Thus, when in place the frustoconical rearwardly projecting portion on the label holder uniquely secures the label holder to the cover plate due to the frictional contact of the frustoconial portion of the label holder with the countersuck aperture in the cover plate.

The label holder is in general a one-piece plastic frame in which slots or notches are made within laterally-opposed sections of the frame. This is accomplished through either drilling through the back of an already existing frame/base unit so as to produce notches from the back at the appropriate locations; or in the molding process for the label holder inserts are positioned at the appropriate positions to provide these notches. A label may be inserted into the frame and overlain with a flexible transparent sheet having outwardly projecting tabs at four corners, with the tabs adapted to fit into the notches made by the above process.

This manner of fabrication of a label-holding frame provides that the label holders can be manufactured at extremely low cost, while providing the above structural advantages.

Regardless of whether the base of the label holder is apertured and provided with a frustoconical projection, such an inexpensive label holder may be provided with an adhesive mounting system to take advantage of the inexpensive nature of the label holder. Thus, labelling any flat surface with such a label holder is within the scope of this invention.

In summary, a cover plate labelling assembly is provided by a label holder which includes a unitary frame and base, in which the frame, in one embodiment, is attached over a anchor the cover plate to its mating switch, receptacle, or junction box. In one embodiment, the aperture is provided with a frustoconical portion projecting rearedly from the back surface of the base, with the aperture being offset downwardly from the center of the base to permit the frame and the label it carries to provide a maximal amount of labelling area and still remain within the confines of the switch plate. The label holder may be used for switches, plugs, or other electrical apparatus which are fastened to outlet boxes in which a covering device is employed and secured in place with screws.

In each embodiment, a removable label is contained under a flexible transparent sheet having opposed tabs which are insertable into mating slots at the interior surfaces of corresponding sides of the frame, with the slots having been made in the frame by either drilling from the back of the base or through the utilization of a molding insert or projection during the molding of the unitary frame/base structure.

In an alternative embodiment the label holder thus constructed can be provided with an adhesive backing material for general use.

The removal of the flexible transparent sheet and label can be easily accomplished by inserting a small pointed object, such as a letter opener, knife, open paper clip, small screwdriver, or a host of other easily obtainable objects, along the sides of the transparent sheet at which the slots are located followed by a prying up step.

BRIEF DESCRIPTION OF THE DRAWINGS

These and other features of the subject invention will be better understood in conjunction with the detailed description taken in conjunction with the drawings of which.

DETAILED DESCRIPTION

Figure 1:
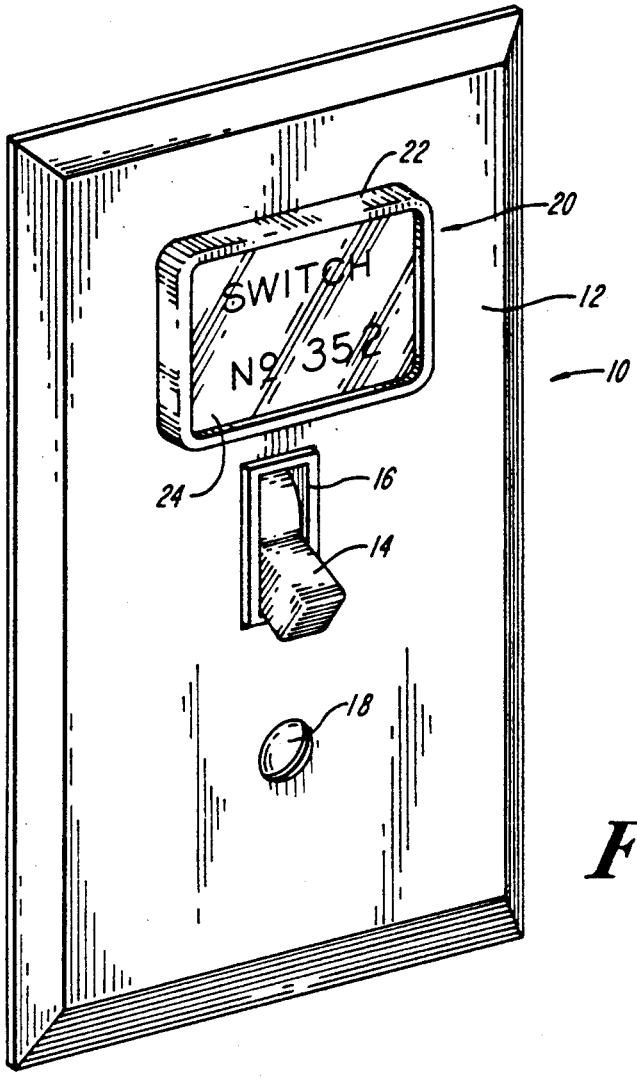
FIG. 1 is a diagrammatic illustration of a label holder secured to a cover plate above a switch.

Referring now to FIG. 1, an electrical switch plate and assembly 10 is shown including a cover or plate 12 and a switch 14 projecting through an aperture 16 in plate 12. Plate 12 is provided with screws 18 for securing the cover plate to switch-carried mounting apparatus (not shown).

Mounted to switch plate 12 is a label-holding assembly generally indicated at reference character 20 as being a label holder which is positioned immediately above the switch and is secured to the cover plate assembly either adhesively or by the screw that is utilized above the switch to hold the cover plate in place against a switch. The labelling assembly in general includes a frame 22 which includes an integral back or base (not shown in this Figure), while also including a flexible transparent cover 24 which overlies a label 26.

Figure 2:
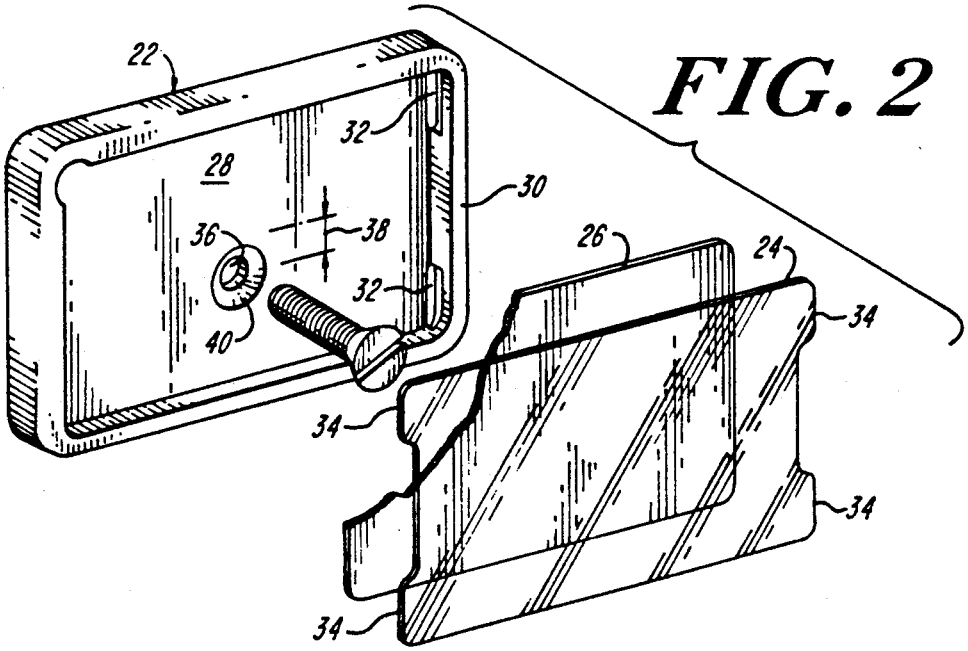
FIG. 2 is an exploded view of the label holder of FIG. 1 illustrating an offset aperture in the base of the assembly, with the label and overlying flexible cover also being illustrated.

Referring now to FIG. 2, in which like reference characters between the figures are given like numbers, it can be seen that label 26 lies between flexible transparent cover 24 and the integral base 28 and is surrounded by a frame 30 having integral slots or notches 32 at the corners thereof which are adapted to receive integral tabs 34 at opposing ends of transparent cover 24.

It will be appreciated that the tabs and notch structure permit easily mounting and demounting of a label in the assembly by snapping the cover in and out of the frame.

As can be seen base 28 of assembly 22 is provided with an aperture 36 which is offset from the center of the base by a distance illustrated by double-ended arrow 38. This aperture permits the lower edge 40 of the assembly to be positioned as close as possible to aperture 16 through which switch 14 protrudes. What this means is that the usable area for indica for the label can be increased to permit the use of large alpha numeric characters while still permitting the assembly to lie within the borders of the cover plate. As will be described, aperture 36 is surrounded by a channelled frustoconical portion 40 which extends rearwardly from the back of base 28.

Figure 3:
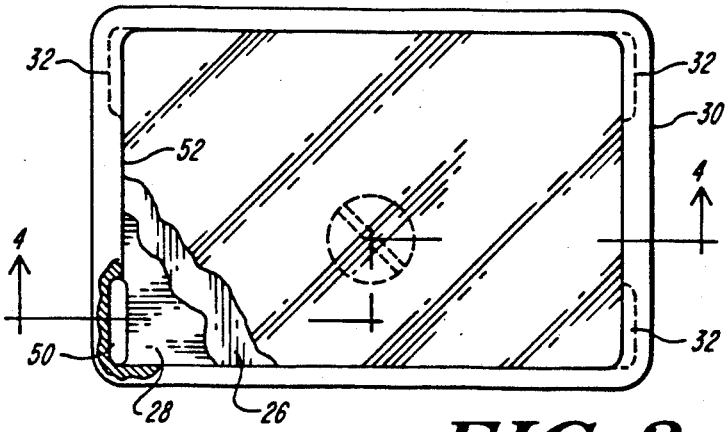
FIG. 3 is a top and partial cutaway view of the assembled label holder of FIGS. 1 and 2, illustrating slots within the frame at the corners thereof.

Referring to FIG. 3 the notch structure 32 in frame 30 is shown in dotted outline and can be formed rather simply by cutting, drilling, or otherwise excavating a slot 50 in base 28. By so doing, a notch is formed in frame 30 so as to produce an undercut structure adapted to receive tabs 34 of transparent cover 24. It will be noted that slot 50 extends past the edge 52 of frame 30 and into the center of the assembly so as to assure opening of a notch at the interior edge or juncture which the frame makes with the base.

Figure 4:
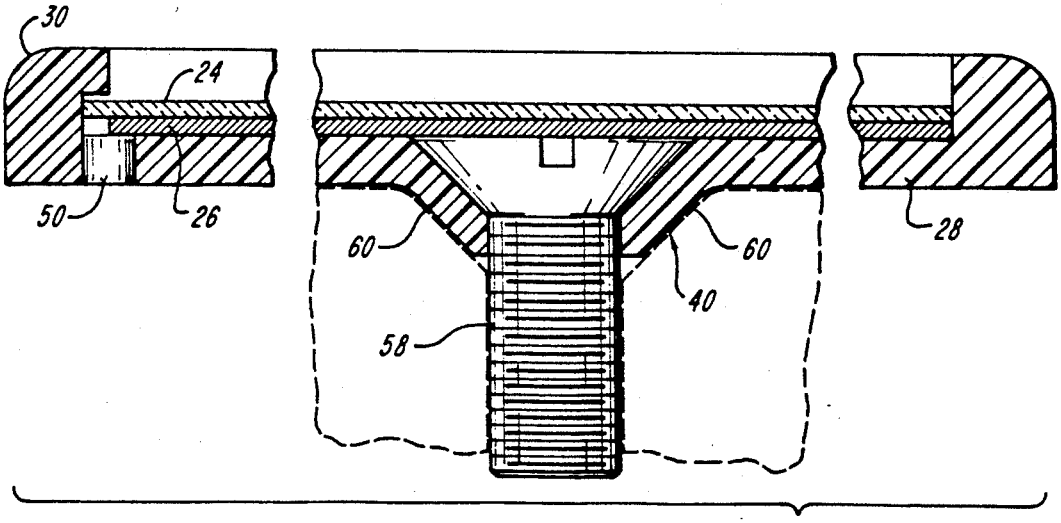
FIG. 4 is a sectional view of the apparatus of FIG. 3 taken along lines 4—4, illustrating the manner in which a slot is provided through aperturing the integral base and frame.

Referring now to FIG. 4, slot 50 is illustrated in as formed in frame 30, such that when produced, it provides a notch 56 to accommodate cover 24 and label 26 as illustrated.

More particularly, with respect to FIG. 4, frustoconical projection 40 depends backwardly from integral base 28 an is configured to house a flat head screw 58 in a tapered or countersunk aperture, with the frustoconical apertured projection accommodating screw 58 as illustrated.

It is the purpose of this frustoconical structure to mate with the countersunk surface of the cover plate surrounding the aperture which normally carries the screw, such that exterior surfaces 60 of the frustoconical projection sit in frictional contact with the countersunk aperture in the cover plate to provide an extremely secure one-point attachment of the labelling assembly to the cover plate.

Figure 5A:
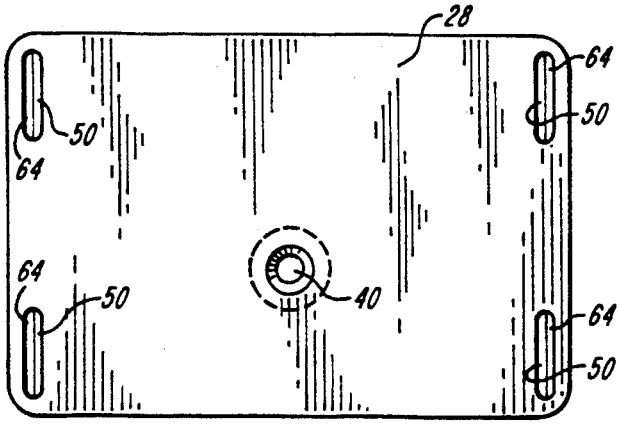
FIG. 5A is a back view of the label holder of FIG. 3, illustrating slotting of the base.
Figure 5B:
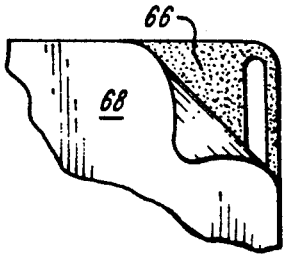
FIG. 5B is a diagrammatic illustration of a portion of the back of the label holder of FIG. 5A, illustrating an adhesive attachment system for the attachment of the label holder to a substrate.

Referring to FIG. 5A, the back side of base 28 is illustrated with slots 50 clearly in evidence. It will be appreciated that slots 50 expose a portion of frame 30, here illustrated at 64, with the drilling or other means for producing the slot, leaving at least a portion of frame 30 above the slot intact. Also shown is the frustoconical projection 40 off centered or downwardly offset as illustrated. FIG. 5B shows an alternative embodiment with adhesive 66 on the back of base 28 covered with a release sheet 68. Note, in this embodiment there is no apertured frustoconical projection, and the label holder is adhesively attached to an underlying substrate.

Figure 6A:
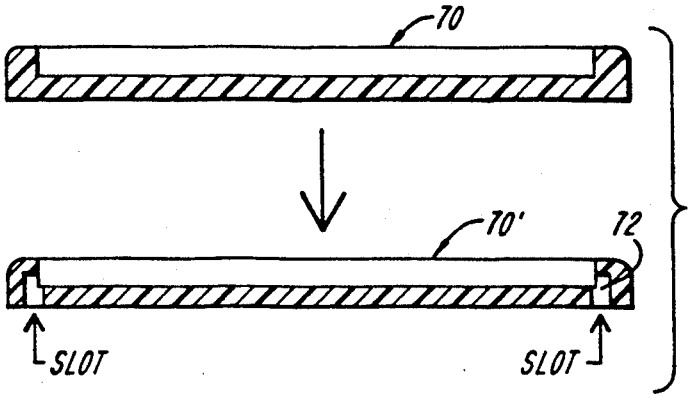
FIGS. 6A and 6B illustrate a manufacturing technique respectively of a side and end view of the unitary label holder of FIGS. 1-3, illustrating the provision of slots in the backside of the unitary assembly to provide notches in the frame.
Figure 6B:
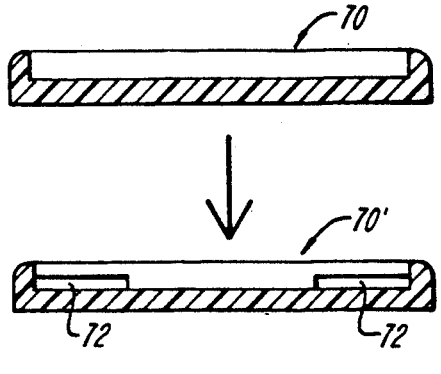

Referring now to FIGS. 6A and 6B, a method for producing the internal slot in a unitary structure is pictured. Here a preformed blank 70 shown respectively in side section and end section is slotted as illustrated in FIG. 6A for producing a blank 70' with a notch 72 by virtue of the slotting operation.

This produces an exceptionally inexpensive label holding assembly and produces notches capable of holding the transparent cover without, for instance, bending metal or otherwise providing a lip to hold the label.

Figure 7A:
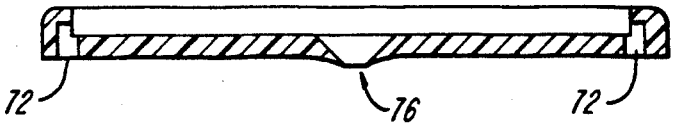
FIGS. 7A and 7B are respectively side and end cross sectional views of a method of manufacturing the label holder of FIGS. 1-3, illustrating the offset aperture and frustoconical portion of the assembly surrounding the frustoconical aperture.
Figure 7B:
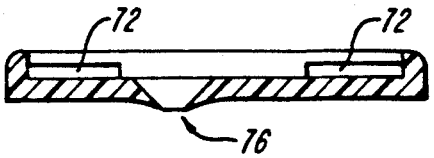

Referring now to FIGS. 7A and 7B which respectively show side and end sections of a further embodiment of the labelling assembly, here it can be seen that the unitary structure can be provided with the frustoconical structure 76 as illustrated along with the aforementioned slots 72.

Figure 8A:
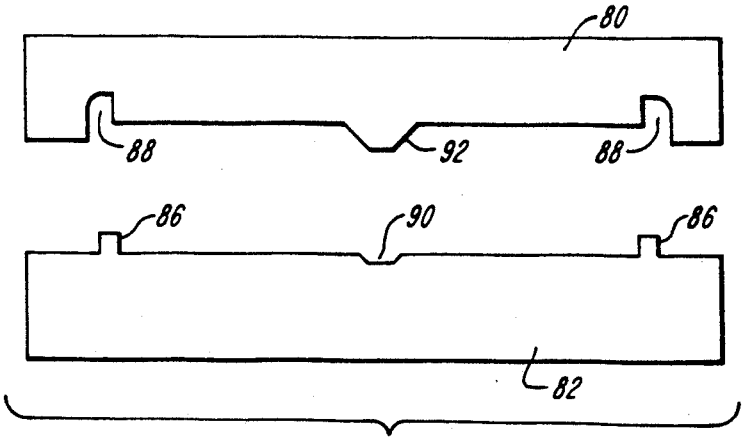
FIGS. 8A and 8B are respectively side and end cross sections of a mold utilized to form the unitary structure of FIGS. 7A and 7B and, FIG. 9 is a diagrammatic representation of the finished notch provided by either of the techniques of FIGS. 6A and 6B or 8A and 8B.
Figure 8B:
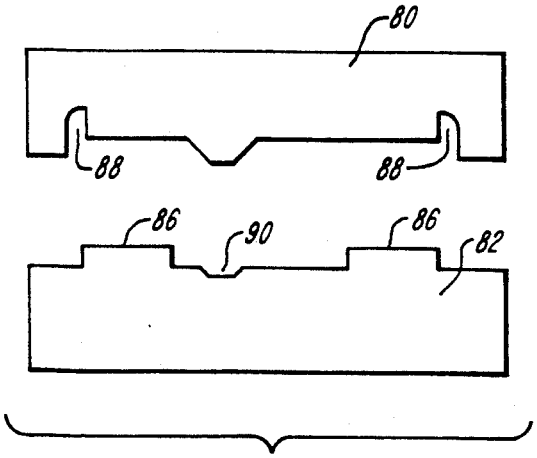

As shown in FIGS. 8A and 8B, the unitary structure can, of course, be formed in a molding operation in which mold halves 80 and 82 are configured as illustrated in side and end section to provide an insert 86 and mating slot 88 for producing the aforementioned slots 72 in the end product. It will be noted that there is a depression 90 in the lower mold half and a corresponding downward projection 92 in the upper mold half to provide the frustoconical structure for the embodiment in which the labelling assemblies are to be secured with a single screw to the cover plate.

In this manner, an extremely inexpensive labelling assembly can be fabricated as a unitary structure.

Figure 9:
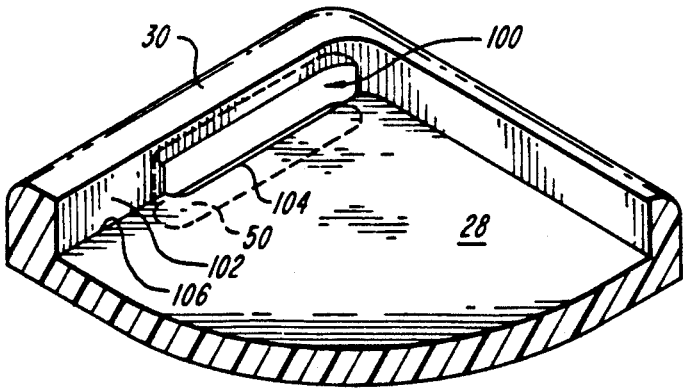

Finally, referring to FIG. 9, slot 50 here shown in dotted outline, is provided in base 28 to provide a notch 100 into which a mating tab on the cover is adapted to be inserted. As can be seen, by providing the upward slot through frame 30 at a corner thereof, notch 100 is formed in the interior wall 102 of frame 30, since the slotting operation provides an edge 104 which is displaced inwardly from edge 106 of frame 30. Note, the notch is made by virtue of providing that the slot be oversized to the extent that it extends into the center of the frame. This being the case, a single slotting operation either by actual material removal or by a mold insert produces the desired inexpensive result.

Having above indicated a preferred embodiment of the Present invention, it will occur to those skilled in the art that modifications and alternatives can be practiced within the spirit of the invention. It is accordingly intended to define the scope of the invention only as indicated in the following claims.

I claim:

1. A labelling assembly for use with an electrical switch box cover plate having mounting holes therein, comprising:

label holder including a unitary rectilinear frame and base defining a cavity opened in an upward direction, said base having an aperture therethrough, said frame having interior opposed sidewalls having slots therein;

a label on top of said base within said frame;

a transparent flexible cover adapted to fit within said frame over said label, said cover having a plurality of laterally extending tabs extending therefrom at opposed edges of said cover at locations adapted to fit within corresponding slots in said frame; and a single screw adapted to pass through said aperture to mount said label holder over one of the cover plate mounting holes, said base including a frustoconical portion projecting rearwardly of said base at said aperture, said frustoconical portion having an aperture therethrough to accommodate said screw, whereby said single screw may be used to secure said labelling assembly over said electrical switch box cover plate.

2. The assembly of claim 1 wherein said base has a center and wherein the aperture in said base is offset from the center thereof.

* * * * *